United States Patent [19]

Paetzold

[11] Patent Number: 4,759,453

[45] Date of Patent: Jul. 26, 1988

[54] LUMINESCENT BABY BOTTLE

[76] Inventor: James M. Paetzold, Box 2044, Hereford, Tex. 79045

[21] Appl. No.: 67,640

[22] Filed: Jun. 26, 1987

[51] Int. Cl.[4] ..... A61J 9/00; A61J 9/08

[52] U.S. Cl. ..... 215/11.1; 215/11.6; 215/100 R

[58] Field of Search ..... 215/11 R–11 E, 215/100 R, 11.1–11.6; 362/101; D24/46–48; 128/359, 360; 446/219

[56] References Cited

U.S. PATENT DOCUMENTS

| | | | |
|---|---|---|---|
| 2,460,221 | 1/1949 | Gordon | 446/219 X |
| 2,582,781 | 1/1952 | Johnson | 362/101 X |
| 2,703,087 | 3/1955 | Newmark | 128/359 |
| 2,836,321 | 5/1958 | Soltesz et al. | 215/11 R |
| 2,954,030 | 9/1960 | Jozwiak | 215/11 R |
| 3,022,915 | 2/1962 | Mullin | 215/11 R |
| 3,159,297 | 12/1964 | Searer | 215/11 R |
| 3,186,411 | 6/1965 | Skidmore | 128/360 |
| 3,232,467 | 2/1961 | Barton | 215/11 E |
| 4,034,213 | 7/1977 | Norris | 362/101 X |
| 4,344,113 | 8/1982 | Ditto et al. | 362/101 |
| 4,563,726 | 1/1986 | Newcomb et al. | 362/101 X |
| 4,570,808 | 2/1906 | Campbell et al. | 215/11 R |
| 4,688,571 | 8/1987 | Tesler | 128/360 |

FOREIGN PATENT DOCUMENTS

| | | | |
|---|---|---|---|
| 2109247 | 6/1983 | United Kingdom | 215/11 C |
| 2169811 | 7/1986 | United Kingdom | 128/360 |

OTHER PUBLICATIONS

Hanovia Technical Data Sheet #91, "Glo Pigment Series 1000", effective: 1/1987, 100 Chestnut St., Newark, N.J. 07105.

*Primary Examiner*—William Price
*Assistant Examiner*—Sue A. Weaver
*Attorney, Agent, or Firm*—Wendell Coffee

[57] ABSTRACT

A baby bottle is marked with a luminescent marker. Therefore, when a baby, old enough to hold the bottle himself, wakes up hungry in the night, the baby can find the bottle due to its luminescence and feed himself without crying to wake his parents. The marker is a band of synthetic plastic with a pigment of inorganic zinc sulfide phosphor with double activators. The band is cylindrical. The bottle is blown within the band.

5 Claims, 1 Drawing Sheet

LUMINESCENT BABY BOTTLE

RIGHTS TO INVENTIONS UNDER FEDERAL RESEARCH

There was no federally sponsored research and development concerning this invention.

BACKGROUND OF THE INVENTION (1) Field of the Invention

This invention relates to baby bottles and more particularly one marked with luminescent material so that the baby may locate the bottle in the dark.

(2) Description of the Related Art

Babies reach a stage of development where they can hold a bottle by themselves and therefore feed themselves. Yet many of these babies will awake hungry in the middle of the night. They will normally cry because of the hunger making it necessary for the parents to arise and give them a bottle for the purpose of feeding even though the baby can hold the bottle by himself.

Before this application was filed, applicant was aware of the following U.S. patents.

JOHNSON U.S. Pat. No. 2,582,781
NEWMARK U.S. Pat. No. 2,703,087
SKIDMORE U.S. Pat. No. 3,186,411
NORRIS U.S. Pat. No. 4,034,213
DITTO ET AL. U.S. Pat. No. 4,344,113
NEWCOMB ET AL. U.S. Pat. No. 4,563,726
CAMBELL ET AL. U.S. Pat. No. 4,570,808

SKIDMORE discloses a luminous pacifier. SKIDMORE describes that a baby will desire to suck or chew on his pacifier during the night but the child will be unable to locate it and will cry until the parent comes and gives him the pacifier. The SKIDMORE solution to this problem is to make a portion of the pacifier luminescent so that the child can find it at night.

JOHNSON discloses a bottle warmer having a portion which is illuminated by a light bulb so that when the bottle is to be warmed at night the warmer can be located for this purpose.

NEWMARK discloses an infants reflective toy teething ring.

The other three patents: NEWCOMB ET AL, NORRIS, and DITTO ET AL, disclose mugs or glasses to illuminate a liquid drink. Applicant would characterized these last three patents as disclosing adult party glasses.

SUMMARY OF THE INVENTION:

(1) Progressive Contribution to the Art

This application provides a solution to the problem outlined above by providing a baby bottle which is marked by a luminous marker so that the child can find the bottle at night, take nourishment, and go back to sleep without waking the parents. Normally when a child is old enough to hold the bottle by himself, it is not necessary to have nourishment at body temperature. Furthermore, the few hours in which the nourishment such as milk will stay at above refrigerated temperatures is not long for any spoilage to occur.

The luminous marker could take several forms. For example, it could be a luminous insulated sack that covered the bottle except for the nipple. Another alternative would be a luminous ribbon which could be tied around the neck of the bottle. Another alternate could be a luminous fabric or paper having an adhesive backing that could be adhered to the bottle. Another type marker could be the ring which normally holds the nipple to the bottle could have a luminescent material included in it.

The preferred embodiment is to form a tube or ring or band of synthetic plastic having a phosphorescent pigment mixed with the plastic. When forming a plastic bottle, the tube is placed in a mold and the bottle is blown within the mold and band.

It will be noted that in all of the above examples that the milk or other nourishment within the bottle never contacts the plastic containing the luminescent material in normal operation.

(2) Objects of this Invention

An object of this invention is to aid an infant in taking nourishment in the dark.

Further objects are to achieve the above with a device that is sturdy, compact, durable, lightweight, simple, safe, efficient, versatile, ecologically compatible, energy conserving, and reliable, yet inexpensive and easy to manufacture, use, and clean.

Other objects are to achieve the above with a method that is safe, versatile, ecologically compatible, energy conserving, rapid, efficient, and inexpensive, and does not require skilled people to use, and clean.

The specific nature of the invention, as well as other objects, uses, and advantages thereof, will clearly appear from the following description and from the accompanying drawing, the different views of which are not scale drawings.

Figure 1:
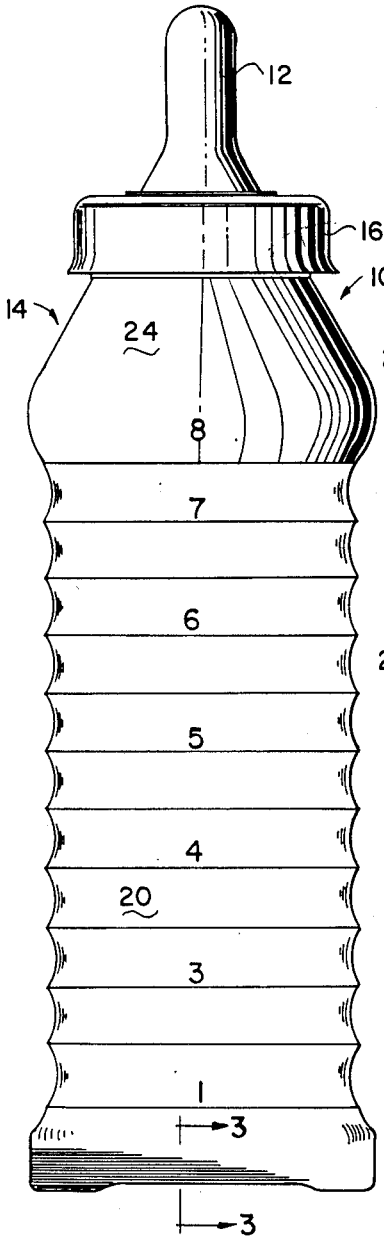
FIG. 1 is a side elevational view of a baby bottle according to this invention.
Figure 2:
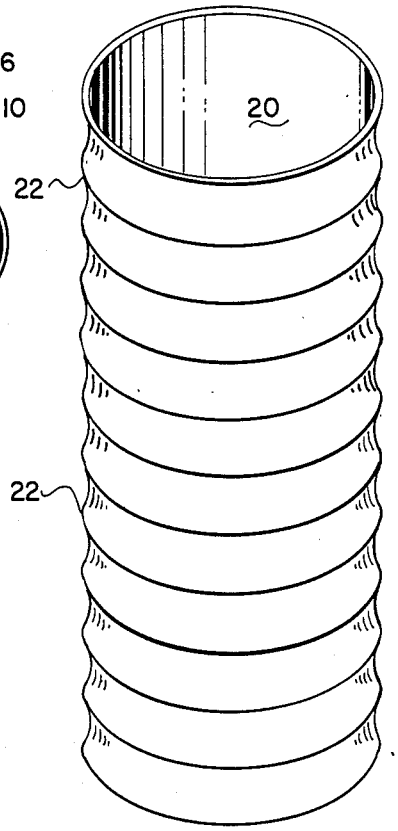
FIG. 2 is a perspective view of the band of luminescent material.
Figure 4:
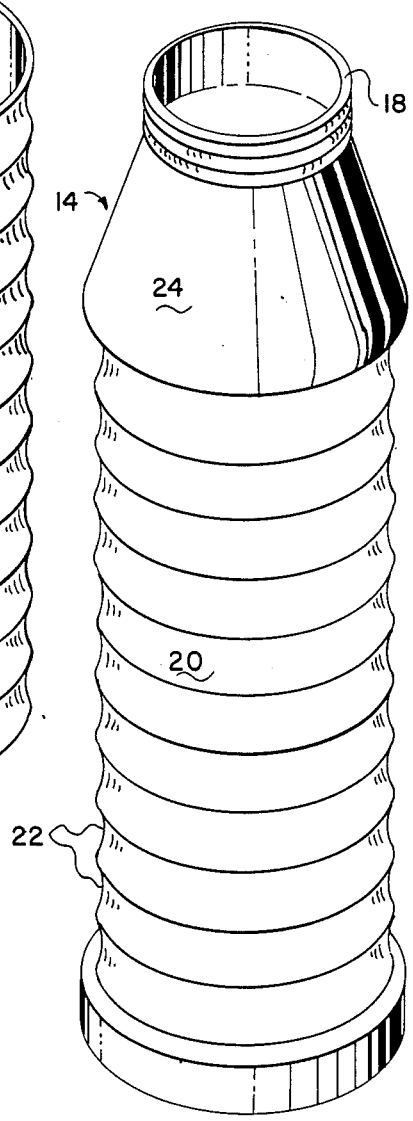
FIG. 4 is a perspective view of the bottle without the top.
Figure 3:
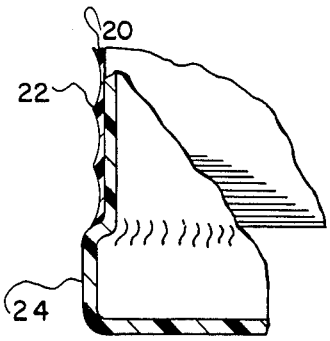
FIG. 3 is a cross sectional section of a portion of the bottle and band of luminescent material.

As an aid to correlating the terms describing this invention to the exemplary drawing the following catalog of elements is provided:

Catalog of Elements

10 nursing unit
12 nipple
14 bottle
16 ring
18 opening
20 band
22 ribs
24 liner

DESCRIPTION OF THE PREFERRED EMBODIMENT

The drawing shows nursing unit 10. The nursing unit will include soft resilient nipple 12, customarily made of rubber, which is attached to the bottle assembly 14 by ring 16.

The bottle 14 is of a general cylindrical shape having a threaded opening 18 at the top to receive the ring 16.

Band 20 is made of luminescent material. The band will extend over a length greater than two-thirds the height of the bottle 14. As may be seen the band is basically a cylindrical tube preferably with plurality of circumferential ribs 22 along its outside surface. The band 20 is made of suitable synthetic material to which has been added a phosphorescent pigment. An inorganic zinc sulfide phosphor with double activators is preferred. One example of such phosphor is a nonradioactive nontoxic pigment produced by the Hanovia Division of Canrad, Inc. at Newark, N.J. This product is marketed as Glow Pigment Series 1000 as described in their Technical Data Sheet #91 dated January 1987. This pigment is a material characterized by a very high initial brightness and a long low afterglow visible in the dark for up to eight hours.

The band 20 is placed in a mold having the shape of the finished bottle and the bottle blown inside the band and mold as is well known in the plastic arts. It may be seen by this process that the luminous marker in the form of the band containing luminescent pigment is connected to the bottle.

The resulting product will be the bottle assembly 14 having a clear plastic container or liner 24. Although the pigment is a stable compound nonradioactive and nontoxic, the band containing the luminescent pigments do not contact the nourishment (normally in the form of milk) contained within the liner 24.

Parents of a baby with this improved nursing unit 10 which is a baby bottle which has been marked with a luminous marker may put liquid nourishment in the bottle and then place the marked bottle in the crib with the baby so that when the baby wakes during the night in the dark the baby can readily find the bottle and take nourishment without waking the parents.

The embodiment shown and described above is only exemplary. I do not claim to have invented all the parts, elements, or steps described. Various modifications can be made in the size, construction, material, arrangement, and operation, and still be within the scope of my invention. For example inasmuch as normally baby bottles contain a measurement marker along the side, I have not shown the same although those with skill in the art will understand these markers would show the contents within the bottle from 0–8 ounces or in the case of smaller bottles from 0–4 ounces.

The restrictive description and drawing of the specific examples above do not point out what an infringement of this patent would be, but are to enable one skilled in the art to make and use the invention. The limits of the invention and the bounds of the patent protection are measured by and defined in the following claims.

I claim as my invention:

1. A nursing unit comprising:

a. a band in the form of a cylindrical tube b. said tube having external circumferential ribs thereon, c. said band having an inorganic zinc sulfide phosphor with double activators therein so that the band is luminous, d. a clear plastic bottle within said band, e. said band extending for over two-thirds the height of the bottle, f. said bottle being blown within said band, g. said bottle having a threaded opening at the top, h. a nipple connected to said top and held in place against said threaded opening.

2. A baby bottle having a nipple connected to the top, wherein the improvement comprises:

a. a luminescent marker connected to the bottle, b. said marker is in the form of a band encircling the bottle, c. said band is made of synthetic plastic with a phosphorescent material in the plastic, and d. the bottle includes a blown plastic cylinder within said band.

3. The invention as defined in claim 2 wherein:

e. said phosphorous material is an inorganic zinc sulfide phosphor with double activators.

4. An nursing unit comprising:

a. a band in the form of a cylindrical tube, b. said band having a phosphorous material therein, c. a plastic container within said band, d. said container having a threaded opening at the top, and e. a nipple connected to said top and held in place by f. a ring against said threaded opening.

5. The invention as defined in claim 4 wherein:

g. said phosphorous material is an inorganic zinc sulfide phosphor with double activators.

* * * * *